US005839579A

United States Patent [19]

Lee

[11] Patent Number: 5,839,579

[45] Date of Patent: Nov. 24, 1998

[54] SLEEVE TOOL KIT

[76] Inventor: Grace Lee, 58, Ma Yuan West St., Taichung, Taiwan

[21] Appl. No.: 55,448

[22] Filed: Apr. 6, 1998

[51] Int. Cl.[6] ..... B65D 85/28

[52] U.S. Cl. ..... 206/378; 206/493; 211/70.6

[58] Field of Search ..... 206/372, 373, 206/376, 377, 378, 493; 211/70.6, 69

[56] References Cited

U.S. PATENT DOCUMENTS

| | | | |
|---|---|---|---|
| 5,114,007 | 5/1992 | Chen | 206/373 |
| 5,145,064 | 9/1992 | Chen | 206/372 |
| 5,407,063 | 4/1995 | Warner et al. | 206/378 |
| 5,484,057 | 1/1996 | Tzu-Ching | 206/374 |
| 5,570,784 | 11/1996 | Sidabras et al. | 206/378 |
| 5,573,116 | 11/1996 | Zink | 206/378 |

*Primary Examiner*—Jacob K. Ackun
*Assistant Examiner*—Nhan T. Lam

[57] ABSTRACT

A sleeve tool kit has a tool box, a recess interior formed in the tool box, and a block seat inserted in the recess interior. The block seat has two opposite balls and a plurality of positioning protrusions. The tool box has two opposite ball-shaped grooves, two opposite round holes, two opposite guide grooves, and two opposite toothed semicircular grooves. The opposite ball-shaped grooves are formed on two opposite ends of the recess interior. The opposite round holes are formed on the opposite ends of the recess interior. The opposite guide grooves are formed on the opposite ends of the recess interior. The opposite toothed semicircular grooves are formed on the opposite ends of the recess interior. Each opposite ball is inserted in the respective opposite ball-shaped groove via the respective opposite round hole and the respective opposite guide groove.

2 Claims, 4 Drawing Sheets

SLEEVE TOOL KIT

BACKGROUND OF THE INVENTION

The present invention relates to a sleeve tool kit. More particularly, the present invention relates to a sleeve tool kit which has a recess interior to receive a block seat.

A conventional sleeve tool kit has a plurality of recess holes to receive sleeves. The sleeves are disposed in the conventional sleeve tool kit perpendicularly. Therefore, the user has to take the sleeves out of the conventional sleeve tool kit perpendicularly. It is not very convenient for the user to take the sleeves out of the conventional sleeve tool kit perpendicularly every time.

SUMMARY OF THE INVENTION

An object of the present invention is to provide a sleeve tool kit which has a recess interior to receive a block seat.

Another object of the present invention is to provide a sleeve tool kit which has a block seat to be disposed in the sleeve tool kit to any angle.

Accordingly, a sleeve tool kit comprises a tool box, a recess interior formed in the tool box, and a block seat inserted in the recess interior. The block seat comprises two opposite balls disposed on two opposite ends of the block seat, and a plurality of positioning protrusions disposed on an outer periphery of the block seat. The tool box further comprises two opposite ball-shaped grooves formed in the tool box, two opposite round holes formed in the tool box, two opposite guide grooves formed in the tool box, and two opposite toothed semicircular grooves formed in the tool box. The opposite ball-shaped grooves are formed on two opposite ends of the recess interior. The opposite round holes are formed on the opposite ends of the recess interior. The opposite guide grooves are formed on the opposite ends of the recess interior. The opposite toothed semicircular grooves are formed on the opposite ends of the recess interior. Each of the opposite round holes communicates with the respective opposite ball-shaped groove. Each of the opposite guide grooves communicates with the respective opposite ball-shaped groove and the respective opposite toothed semicircular groove. Each of the opposite balls is inserted in the respective opposite ball-shaped groove via the respective opposite round hole and the respective opposite guide groove.

DETAILED DESCRIPTION OF THE INVENTION

Figure 1:
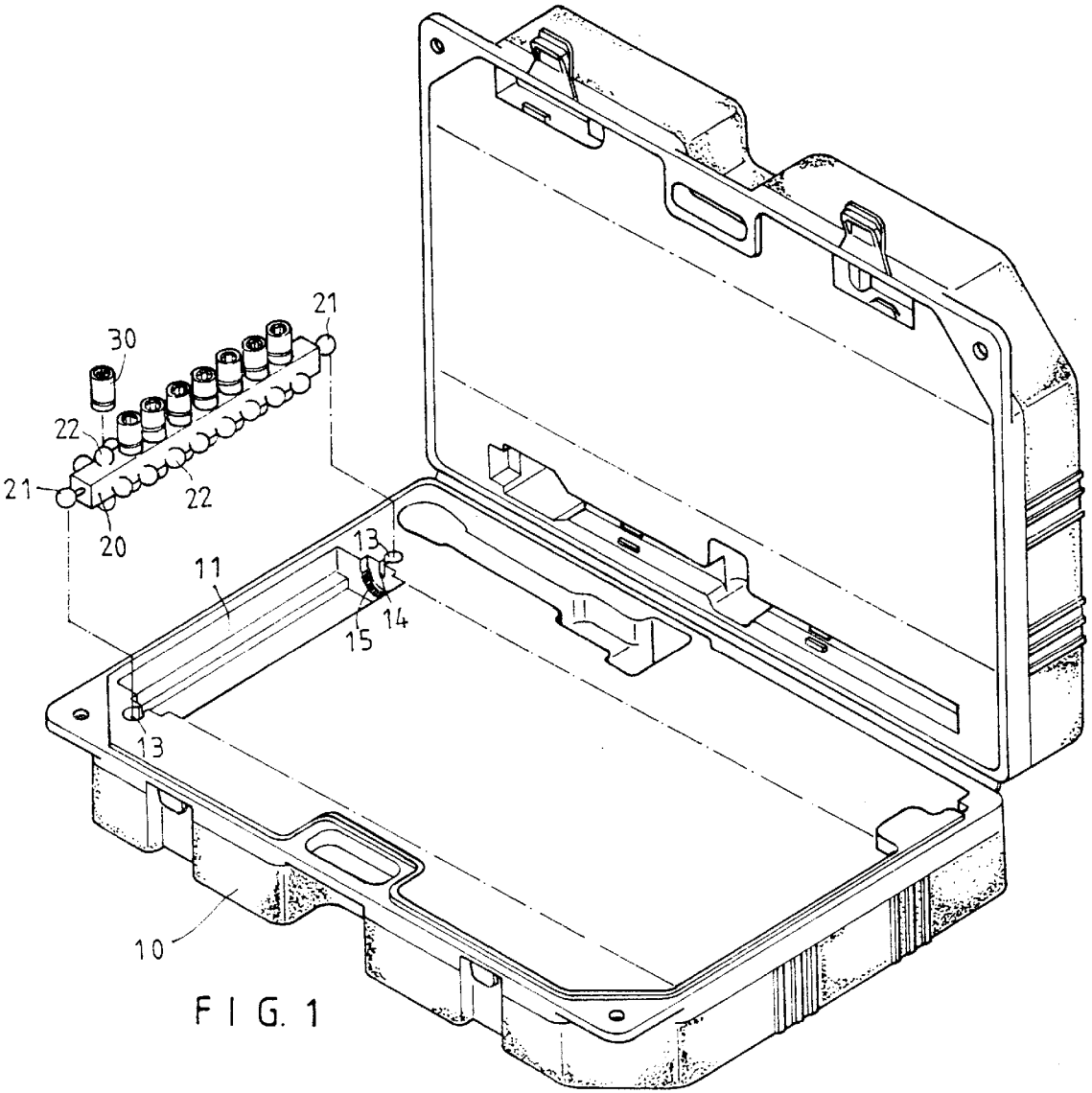
FIG. 1 is a perspective exploded view of a sleeve tool kit of a preferred embodiment in accordance with the present invention.
Figure 2:
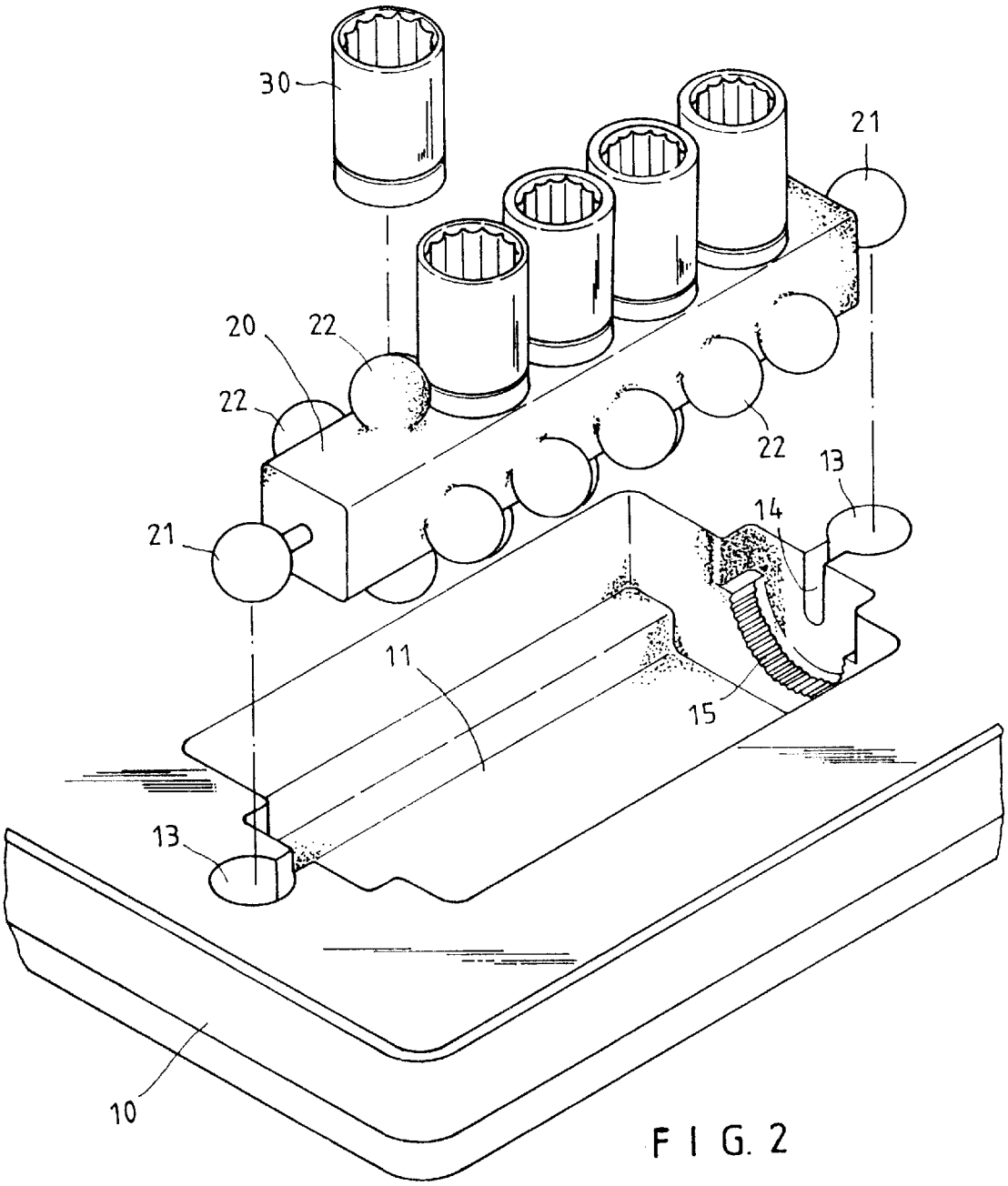
FIG. 2 is a partially enlarged perspective exploded view of a sleeve tool kit of a preferred embodiment in accordance with the present invention.
Figure 3:
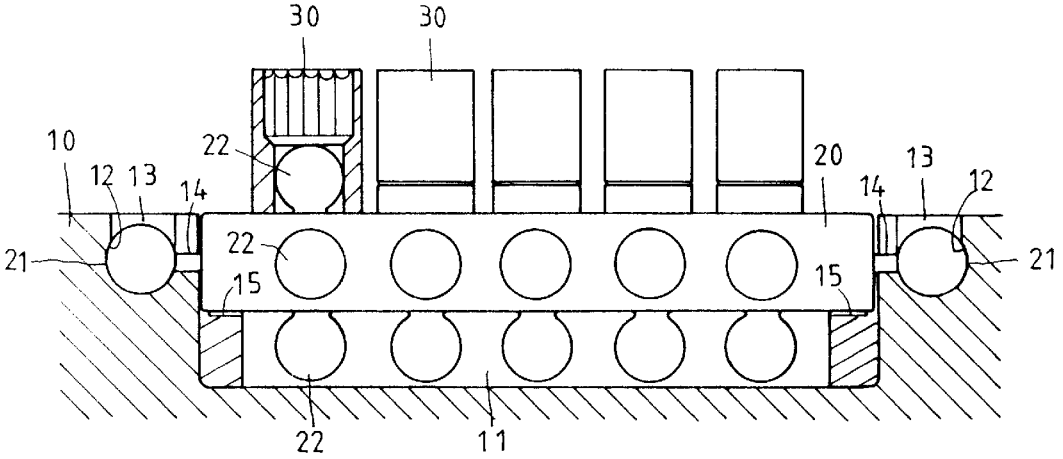
FIG. 3 is a sectional assembly view of a sleeve tool kit of a preferred embodiment in accordance with the present invention.

Referring to FIGS. 1 to 3, a sleeve tool kit comprises a tool box 10, a recess interior 11 formed in the tool box 10, and a block seat 20 inserted in the recess interior 11.

The present invention provides the following feature structures.

The block seat 20 comprises two opposite balls 21 disposed on two opposite ends of the block seat 20, and a plurality of positioning protrusions 22 disposed on an outer periphery of the block seat 20.

The tool box 10 comprises two opposite ball-shaped grooves 12 formed in the tool box 10, two opposite round holes 13 formed in the tool box 10, two opposite guide grooves 14 formed in the tool box 10, and two opposite toothed semicircular grooves 15 formed in the tool box 10.

The opposite ball-shaped grooves 12 are formed on two opposite ends of the recess interior 11. The opposite round holes 13 are formed on the opposite ends of the recess interior 11. The opposite guide grooves 14 are formed on the opposite ends of the recess interior 11. The opposite toothed semicircular grooves 15 are formed on the opposite ends of the recess interior 11.

Each of the opposite round holes 13 communicates with the respective opposite ball-shaped groove 12. Each of the opposite guide grooves 14 communicates with the respective opposite ball-shaped groove 12 and the respective opposite toothed semicircular groove 15.

Each of the opposite balls 21 is inserted in the respective opposite ball-shaped groove 12 via the respective opposite round hole 13 and the respective opposite guide groove 14.

The outer periphery of the block seat 20 has four faces.

Each of the positioning protrusions 22 receives a sleeve 30.

When the block seat 20 is inserted in the recess interior 11, each of the opposite ends of the block seat 20 engages with the respective opposite toothed semicircular groove 15.

Figure 4:
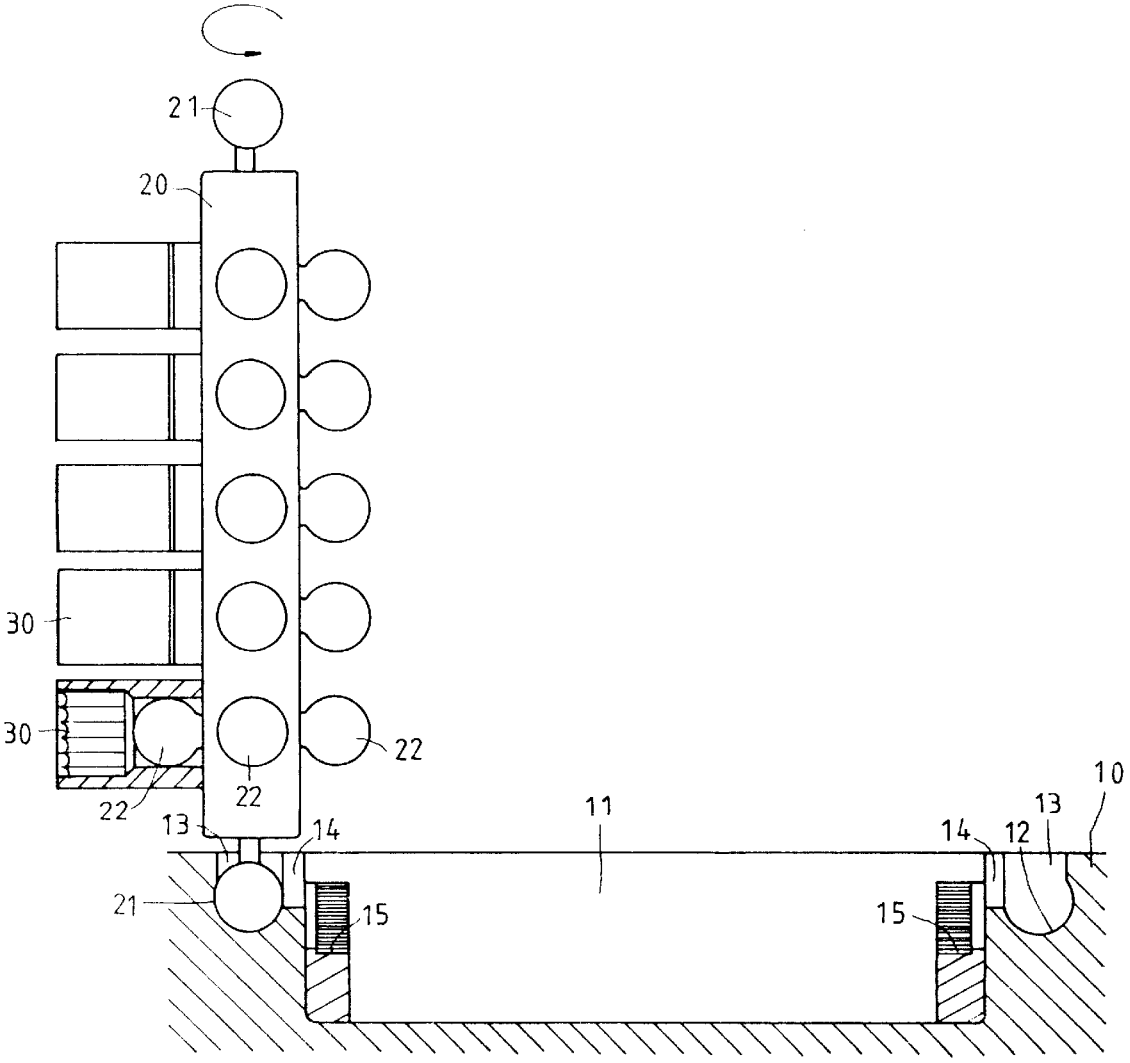
FIG. 4 is a schematic view illustrating an application of a sleeve tool kit of a preferred embodiment in accordance with the present invention.

Referring to FIG. 4, the block seat 20 can be moved upward so that the user can take the sleeve 30 easily. One of the opposite balls 21 remains in the respective opposite ball-shaped groove 12, and the block seat 20 can be rotated to any angle.

Figure 5:
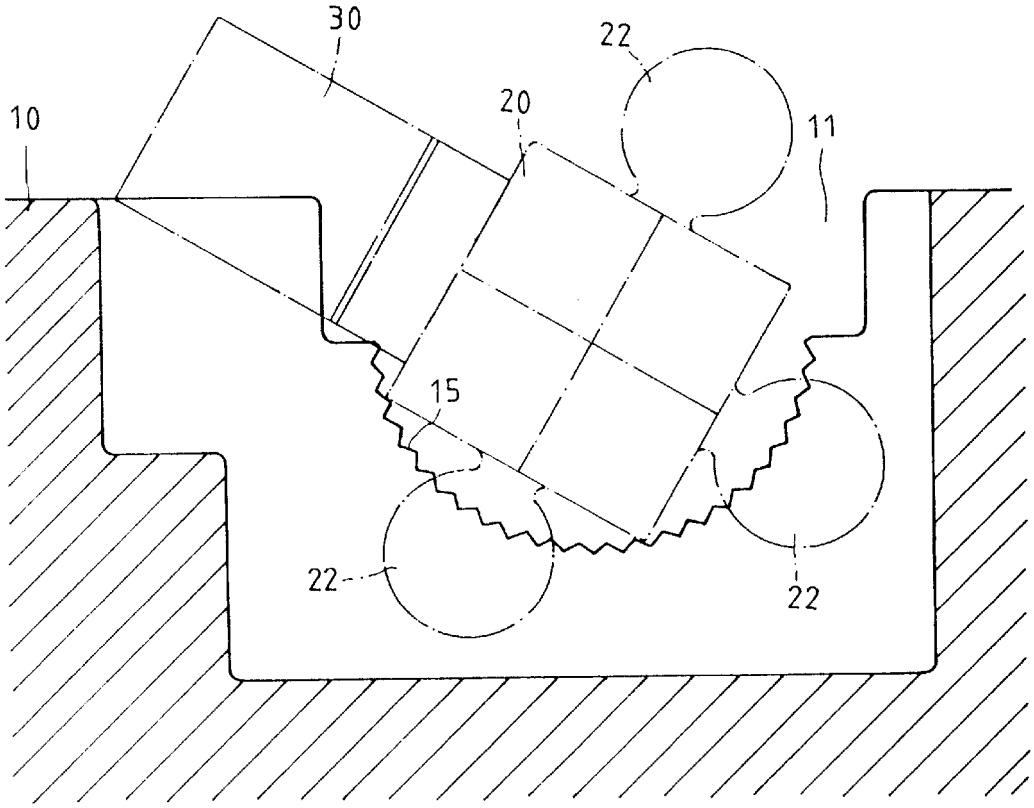
FIG. 5 is a schematic view illustrating a block seat disposed in a sleeve tool kit.

Referring to FIG. 5, the block seat 20 can be positioned in a predetermined angle.

Figure 6:
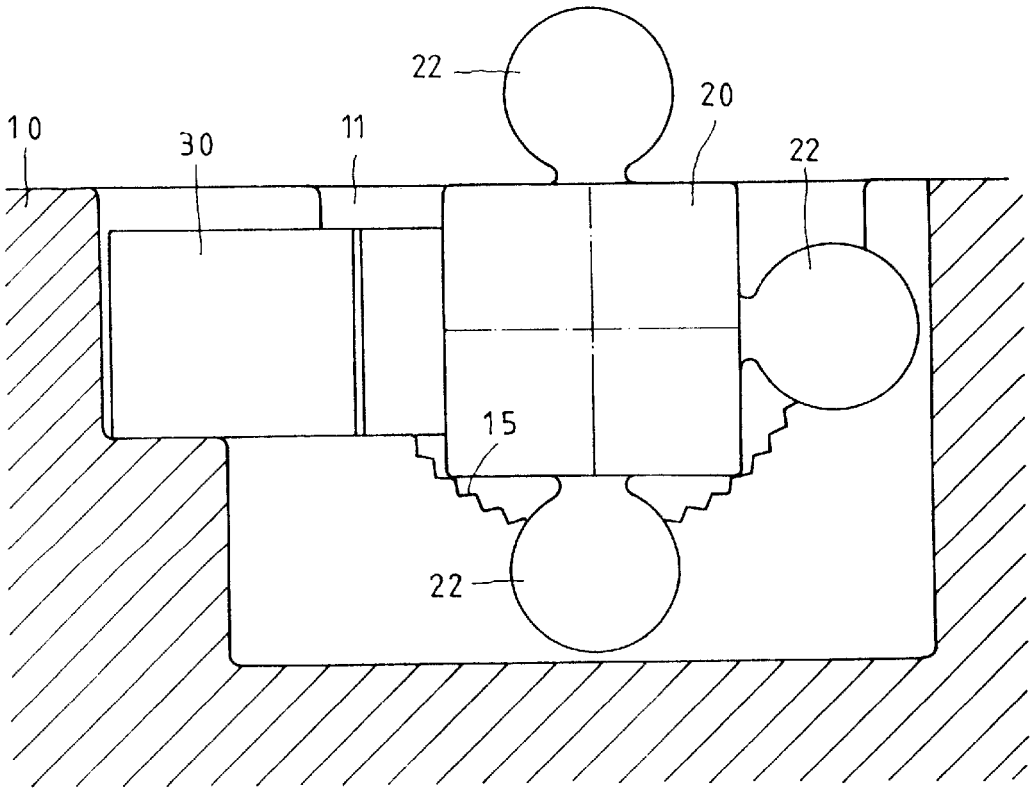
FIG. 6 is another schematic view illustrating a block seat disposed in a sleeve tool kit.

Referring to FIG. 6, the block seat 20 can be positioned in another predetermined angle.

The present invention is not limited to the above embodiment but various modification thereof may be made. Furthermore, various changes in form and detail may be made without departing from the scope of the present invention.

I claim:

1. A sleeve tool kit comprises:

a tool box, a recess interior formed in the tool box, a block seat inserted in the recess interior, the block seat comprising two opposite balls disposed on two opposite ends of the block seat, and a plurality of positioning protrusions disposed on an outer periphery of the block seat, the tool box further comprising two opposite ball-shaped grooves formed in the tool box, two opposite round holes formed in the tool box, two opposite guide grooves formed in the tool box, and two opposite toothed semicircular grooves formed in the tool box, the opposite ball-shaped grooves formed on two opposite ends of the recess interior, the opposite round holes formed on the opposite ends of the recess interior, the opposite guide grooves formed on the opposite ends of the recess interior, the opposite toothed semicircular grooves formed on the opposite ends of the recess interior, each of the opposite round holes communicating with the respective opposite ball-shaped groove, each of the opposite guide grooves communicating with the respective opposite ball-shaped groove and the respective opposite toothed semicircular groove, and each of the opposite balls inserted in the respective opposite ball-shaped groove via the respective opposite round hole and the respective opposite guide groove.

2. A sleeve tool kit as claimed in claim 1, wherein the outer periphery of the block seat has four faces.

* * * * *